US010170053B2

(12) United States Patent
Noh et al.

(10) Patent No.: US 10,170,053 B2
(45) Date of Patent: Jan. 1, 2019

(54) GATE DRIVING MODULE AND GATE-IN-PANEL

(71) Applicant: LG DISPLAY CO., LTD., Seoul (KR)

(72) Inventors: Seok Noh, Chungcheongnam-do (KR); InHyo Han, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 30 days.

(21) Appl. No.: 15/391,188

(22) Filed: Dec. 27, 2016

(65) Prior Publication Data

US 2017/0193917 A1 Jul. 6, 2017

(30) Foreign Application Priority Data

Dec. 30, 2015 (KR) ..... 10-2015-0189958

(51) Int. Cl.
*G09G 3/3266* (2016.01)
*G09G 3/3233* (2016.01)
*G09G 3/36* (2006.01)

(52) U.S. Cl.
CPC ..... *G09G 3/3266* (2013.01); *G09G 3/3233* (2013.01); *G09G 3/3677* (2013.01); *G09G 2300/0439* (2013.01); *G09G 2300/0871* (2013.01); *G09G 2310/0267* (2013.01); *G09G 2310/0281* (2013.01); *G09G 2310/0286* (2013.01); *G09G 2310/0291* (2013.01); *G09G 2320/0223* (2013.01)

(58) Field of Classification Search
CPC .. G09G 3/3266; G09G 3/3233; G09G 3/3677; G09G 2320/0223; G09G 2310/0291; G09G 2310/0286; G09G 2310/0281; G09G 2300/0871; G09G 2300/0439; G09G 2310/0267
See application file for complete search history.

(56) References Cited

U.S. PATENT DOCUMENTS

2007/0085811 A1* 4/2007 Lee ..... G09G 3/3677 345/100
2008/0100560 A1* 5/2008 Na ..... G09G 3/3677 345/101
2009/0256794 A1 10/2009 Jang et al.
2010/0066922 A1 3/2010 Kumada
(Continued)

FOREIGN PATENT DOCUMENTS

CN 1725287 A 1/2006
CN 103035298 A 4/2013
(Continued)

*Primary Examiner* — Ibrahim A Khan
(74) *Attorney, Agent, or Firm* — Dentons US LLP

(57) ABSTRACT

A gate driving module and a gate-in-panel comprising a first pull-up TFT having a terminal connected to a gate driving signal generator and another terminal connected to an end of a first gate line, a first pull-down TFT having a terminal connected to the end of the first gate line and another terminal connected to a low-level voltage terminal, and a second pull-up TFT having a terminal connected to the gate driving signal generator and another terminal connected to another end opposite to the end of the first gate line, wherein the first pull-down TFT is turned off when the first pull-up TFT and the second pull-up TFT are turned on, and the first pull-down TFT is turned on when the first pull-up TFT and the second pull-up TFT are turned off.

14 Claims, 7 Drawing Sheets

(56) References Cited

U.S. PATENT DOCUMENTS

2011/0058642 A1* 3/2011 Tsai ..... G09G 3/3677 377/79
2011/0298771 A1* 12/2011 Yoo ..... G09G 3/20 345/211
2012/0269316 A1* 10/2012 Jang ..... G09G 3/3677 377/75
2013/0106677 A1 5/2013 Koo et al.
2013/0243150 A1 9/2013 Jang et al.
2014/0028534 A1* 1/2014 Park ..... G09G 3/34 345/84
2014/0092078 A1* 4/2014 Yoon ..... G09G 5/001 345/212
2014/0218274 A1 8/2014 Yamashita
2015/0262524 A1* 9/2015 Choe ..... G09G 3/3233 345/77
2015/0371598 A1 12/2015 So et al.
2016/0019840 A1* 1/2016 Cao ..... G09G 3/3266 345/214
2017/0097650 A1* 4/2017 Zhang ..... G09G 3/20
2017/0103698 A1* 4/2017 Xiao ..... G09G 3/2085
2017/0287428 A1* 10/2017 Xue ..... G09G 3/3677

FOREIGN PATENT DOCUMENTS

CN 103714789 A 4/2014
CN 105047119 A 11/2015
GB 2439607 A 1/2008
JP 2006-293299 A 10/2006
JP 2007-241027 A 9/2007
JP 2007-241028 A 9/2007
JP 2010140593 A 6/2010
JP 2010-238323 A 10/2010
JP 2015-068978 A 4/2015
KR 10-2015-0071782 A 6/2015
KR 10-2015-0078248 A 7/2015
TW 201110095 A1 3/2011
TW I493872 B 7/2015
TW I500012 B 9/2015
WO 2008/093458 A1 8/2008
WO 2014172960 A1 10/2014

* cited by examiner

GATE DRIVING MODULE AND GATE-IN-PANEL

CROSS REFERENCE TO RELATED APPLICATION

This application claims the benefit of Korean Patent Application No. 10-2015-0189958, filed on Dec. 30, 2015, entitled "GATE DRIVING MODULE AND GATE-IN-PANEL", which is hereby incorporated by reference in its entirety into this application.

BACKGROUND

1. Technical Field

The present disclosure relates to a gate driving module and a gate-in-panel, and more specifically, to a gate driving module and a gate-in-panel that reduce a number of TFTs by sharing a pull-down TFT and thereby reduce a thickness of a bezel.

2. Description of the Related Art

In today's information technology era, the technology associated with flat display devices, such as information contained in electrical signals in the form of visual images, is rapidly evolving. In particular, research to develop thinner and lighter flat display devices with less power consumption is ongoing.

Flat display devices include liquid-crystal display (LCD) devices, plasma display panel (PDP) devices, field emission display (FED) devices, electro luminescence display (ELD) devices, electro-wetting display (EWD) devices and organic light-emitting display (OLED) devices.

Among these, an OLED device displays images by using organic light-emitting diodes (OLEDs) that are self-luminous. Such an OLED device includes two or more organic light-emitting diodes that emit light of different colors, such that colorful images can be displayed without additional color filters as in other devices such as LCD devices. In addition, since an OLED device requires no separate light source, it can be lighter and thinner and has a wider viewing angle than an LCD device. Further, an OLED device has a response speed which is at least one thousand times faster than an LCD device, so that it barely leaves afterimages.

Such an OLED device displays images by applying voltage to a gate line to turn on a scan transistor. When the scan transistor is turned on, the voltage is applied via a data line to turn on a driving transistor. When the driving transistor is turned on, current flows through the driving transistor to turn on an organic light-emitting diode. To perform these functions, a gate driving module for applying voltage to the gate line is required.

The conventional gate driving module has shortcomings in that it includes a large number of TFTs for driving gate lines, and thus the bezel of the gate driving module is thicker. In addition, because the conventional gate driving module has a thick bezel, it is difficult for viewers to get immersed in the content displayed on the screen, and the overall volume of the panel is increased. In addition, the existing gate driving module has the problem in that it requires a large number of $Q_b$ nodes and inverters for driving the gate lines.

SUMMARY

It is an object of the present disclosure to provide a gate driving module and a gate-in-panel that reduce the number of TFTs by sharing a pull-down TFT.

It is another object of the present disclosure to provide a gate driving module and a gate-in-panel that reduce the thickness of the bezel by reducing the number of TFTs.

It is another object of the present disclosure to provide a gate driving module and a gate-in-panel that reduce the thickness of the bezel to thereby allow a viewer a more immersive visual experience.

It is another object of the present disclosure to provide a gate driving module and a gate-in-panel that reduce the thickness of the bezel to reduce the overall volume of the panel.

It is another object of the present disclosure to provide a gate driving module and a gate-in-panel that reduce the number of $Q_b$ nodes by sharing a $Q_b$ node.

It is another object of the present disclosure to provide a gate driving module and a gate-in-panel that reduce the number of inverters by sharing a $Q_b$ node.

It is another object of the present disclosure to provide a gate driving module and a gate-in-panel that control turn-on and turn-off operations of a scan transistor.

It is another object of the present disclosure to provide a gate driving module and a gate-in-panel that can control turn-on and turn-off timings of an organic light-emitting diode by controlling turn-on and turn-off operations of a scan transistor.

It is another object of the present disclosure to provide a gate driving module and a gate-in-panel that can apply a gate driving signal to a first pull-up TFT and a second pull-up TFT simultaneously.

It is another object of the present disclosure to provide a gate driving module and a gate-in-panel that apply a gate driving signal to a first pull-up TFT and a second pull-up TFT simultaneously to thereby reduce a delay between voltage signals applied to an active area.

In accordance with one aspect of the present disclosure, there is provided a gate driving module that can reduce the number of TFTs by sharing a pull-down TFT and thus reduce the thickness of the bezel.

More specifically, when a first pull-up TFT and a second pull-up TFT are turned on, a first pull-down TFT is turned off. When the first pull-up TFT and the second pull-up TFT are turned off, the first pull-down TFT is turned on. When the first pull-up TFT and the second pull-up TFT are turned on, a gate driving signal is applied to the gate line via the first pull-up TFT and the second pull-up TFT. Then, when the first pull-down TFT is turned on, a low-level voltage signal is applied to the gate line via the first pull-down TFT. As set forth above, the gate driving signal and the low-level voltage signal are applied by using only the first pull-up TFT, the second pull-up TFT and the first pull-down TFT, so that the number of the TFT can be reduced and the thickness of the bezel can be reduced.

The gate driving module may further include a first inverter having a terminal connected to the gate terminal of the first pull-up TFT and the other terminal connected to the gate terminal of the first pull-down TFT.

A $Q_b$3 node connected to the gate terminal of a third pull-up TFT via a third inverter may be connected to a $Q_b$2 node. The $Q_b$2 node may be connected to the gate terminal of the second pull-up TFT via a second inverter. As set forth above, the $Q_b$3 node is connected to the $Q_b$2 node, so that the number of the $Q_b$ nodes can be reduced, and the number of the inverters can be reduced.

Accordingly, the gate driving module may share the pull-down TFT and the $Q_b$ node, so that the number of TFTs, the number of $Q_b$ node, and the number of the inverters can be reduced.

In accordance with another aspect of the present disclosure, there is provided a gate-in-panel that can reduce the number of TFTs by sharing a pull-down TFT and thus reduce the thickness of the bezel.

More specifically, when a first pull-up TFT and a second pull-up TFT are turned on, a first pull-down TFT is turned off. When the first pull-up TFT and the second pull-up TFT are turned off, the first pull-down TFT is turned on. When the first pull-up TFT and the second pull-up TFT are turned on, a gate driving signal is applied to the gate line via the first pull-up TFT and the second pull-up TFT. Then, when the first pull-down TFT is turned on, a low-level voltage signal is applied to the gate line via the first pull-down TFT. As set forth above, the gate driving signal and the low-level voltage signal are applied by using only the first pull-up TFT, the second pull-up TFT and the first pull-down TFT, so that the number of the TFT can be reduced and the thickness of the bezel can be reduced.

The gate-in-panel may further include an active area where a scan operation is carried out by a gate driving signal applied via the first gate line.

The gate-in-panel may further include a first inverter having a terminal connected to the gate terminal of the first pull-up TFT and the other terminal connected to the gate terminal of the first pull-down TFT.

A $Q_b$3 node connected to the gate terminal of a third pull-up TFT via a third inverter may be connected to a $Q_b$2 node. The $Q_b$2 node may be connected to the gate terminal of the second pull-up TFT via a second inverter. As set forth above, the $Q_b$3 node is connected to the $Q_b$2 node, so that the number of the $Q_b$ nodes can be reduced, and the number of the inverters can be reduced.

Accordingly, the gate-in-panel may share the pull-down TFT and the $Q_b$ node, so that the number of TFTs, the number of $Q_b$ node, and the number of the inverters can be reduced.

According to an exemplary embodiment of the present disclosure, the number of TFTs can be reduced by sharing a pull-down TFT. For example, a gate driving module and a gate-in-panel according to an exemplary embodiment of the present disclosure can be usefully utilized by reducing the thickness of the bezel to allow viewers a more immersive visual experience. That is, the display device with the thinner bezel provides a more screen real estate, allowing a viewer to get immersed in the content displayed in the screen when the viewer watches a movie or a drama.

In addition, according to an exemplary embodiment of the present disclosure, the overall volume of the panel with respect to the size of the screen can be reduced by reducing the thickness of the bezel. For example, a gate driving module and a gate-in-panel according to an exemplary embodiment of the present disclosure can be usefully utilized by reducing the overall volume of the panel to reduce unnecessary space.

In addition, according to an exemplary embodiment of the present disclosure, the number of $Q_b$ nodes can be reduced by sharing a $Q_b$ node. For example, a gate driving module and a gate-in-panel according to an exemplary embodiment of the present disclosure can be usefully utilized by reducing the number of $Q_b$ nodes by connecting a $Q_b$ node to another $Q_b$ node. By sharing a $Q_b$ node, the inverter connected to the $Q_b$ node can also be shared, such that the thickness of the bezel can be reduced.

In addition, according to an exemplary embodiment of the present disclosure, turn-on and turn-off operations of a scan transistor can be controlled. For example, a gate driving module and a gate-in-panel according to an exemplary embodiment of the present disclosure can be usefully utilized by controlling the turn-on and turn-off operations of a pull-up TFT and a pull-down TFT to control a voltage signal applied to a gate line.

In addition, by controlling the turned-on and turned-off operations of the scan transistor, turned-on and turned-off timings of an organic light-emitting diode (OLED) can be controlled. For example, a gate driving module and a gate-in-panel according to an exemplary embodiment of the present disclosure can be usefully utilized by turning on or off organic light-emitting diodes in an arbitrary order.

In addition, according to an exemplary embodiment of the present disclosure, a delay between voltage signals applied to the active area can be reduced. For example, a gate driving module and a gate-in-panel according to an exemplary embodiment of the present disclosure can be usefully utilized when voltage signals applied to the active area are ununiform so that the timings of turning on and off the organic light-emitting diodes become irregular.

BRIEF DESCRIPTION OF DRAWINGS

FIG. 2(*b*) is a diagram showing a voltage signal applied to the gate terminal of a pull-up TFT according to an exemplary embodiment of the present disclosure;

FIG. 2(*c*) is a diagram showing a voltage signal applied to the gate terminal of a pull-down TFT according to an exemplary embodiment of the present disclosure;

FIG. 2(*d*) is a diagram showing a voltage signal applied to a gate line according to an exemplary embodiment of the present disclosure;

DETAILED DESCRIPTION

Figure 1:
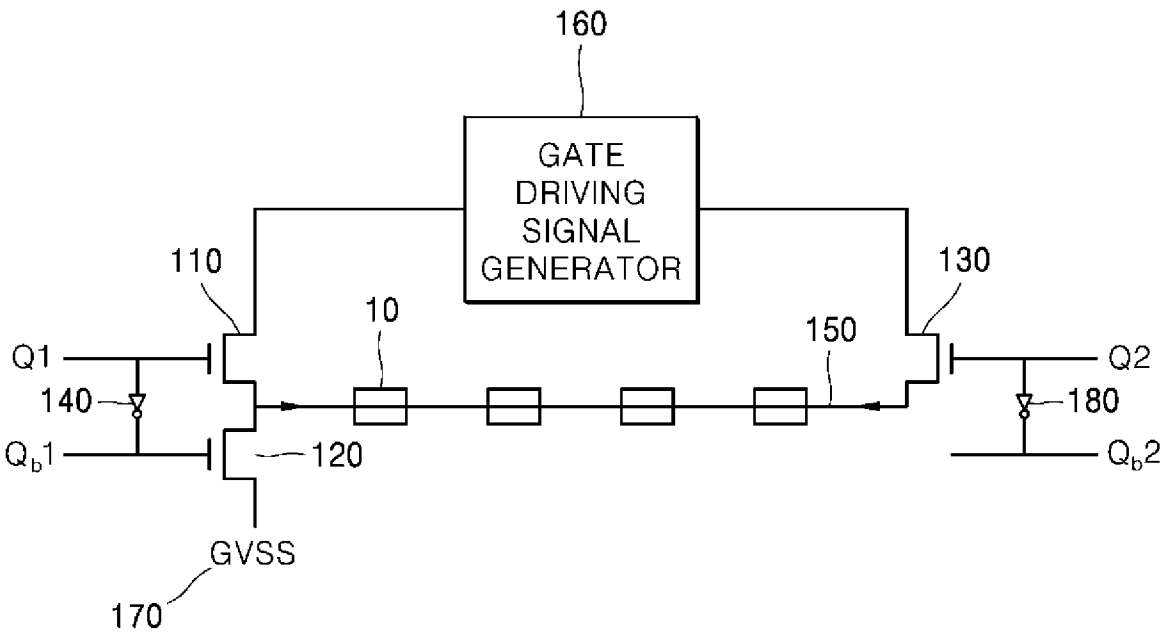
FIG. 1 is a diagram for illustrating a gate driving module according to an exemplary embodiment of the present disclosure.
Figure 2A:
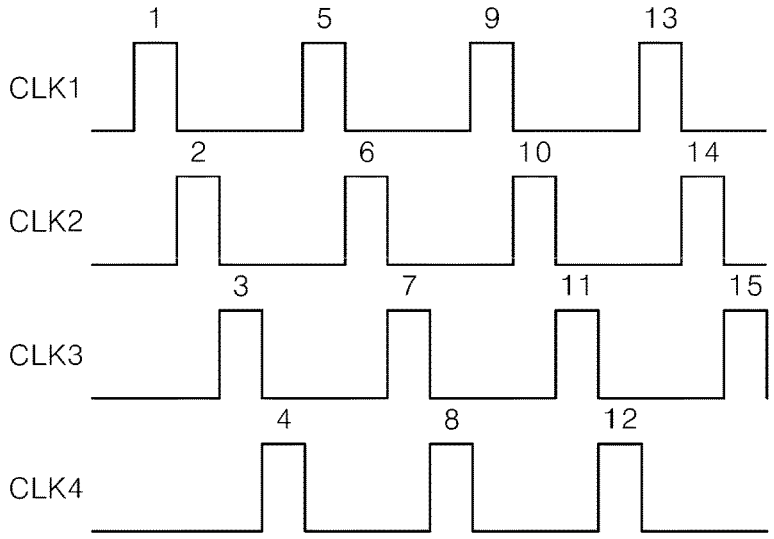
FIG. 2(*a*) is a diagram showing gate driving signals according to an exemplary embodiment of the present disclosure.
Figure 2B:
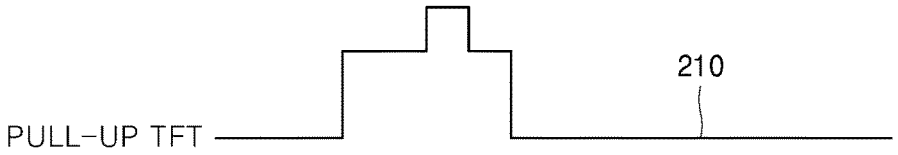
Figure 2C:
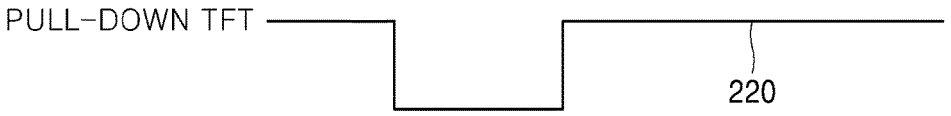
Figure 2D:
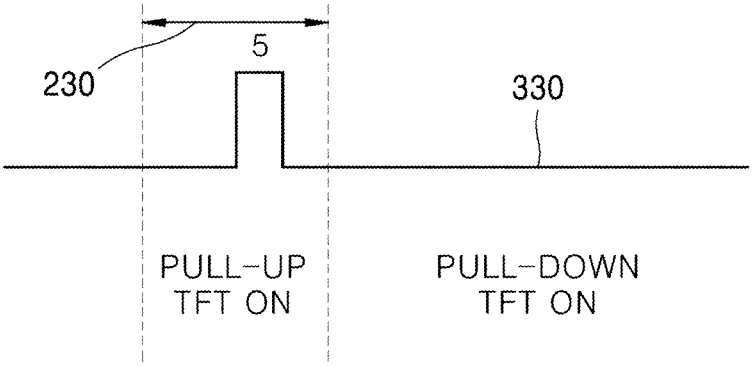

The above objects, features and advantages will become apparent from the detailed description with reference to the accompanying drawings. Embodiments are described in sufficient detail to enable those skilled in the art in the art to easily practice the technical idea of the present disclosure. Detailed descriptions of well known functions or configurations may be omitted in order not to unnecessarily obscure the gist of the present disclosure. Hereinafter, embodiments of the present disclosure will be described in detail with reference to the accompanying drawings. Throughout the drawings, like reference numerals refer to like elements.

FIG. 1 is a diagram for illustrating a gate driving module according to an exemplary embodiment of the present disclosure. Referring to FIG. 1, a gate driving module according to an exemplary embodiment of the present disclosure may include a first pull-up TFT 110, a first pull-down TFT 120, and a second pull-up TFT 130. The gate driving module shown in FIG. 1 is merely an exemplary embodiment of the present disclosure, and the elements are not limited to those shown in FIG. 1. Some elements may be added, modified or eliminated as desired.

FIG. 2(*a*) is a diagram showing gate driving signals according to an exemplary embodiment of the present disclosure. FIG. 2(*b*) is a diagram showing a voltage signal applied to the gate terminal of a pull-up TFT according to an exemplary embodiment of the present disclosure.

FIG. 2(*c*) is a diagram showing a voltage signal applied to the gate terminal of a pull-down TFT according to an exemplary embodiment of the present disclosure. FIG. 2(*d*) is a diagram showing a voltage signal applied to a gate line according to an exemplary embodiment of the present disclosure.

Figure 3:
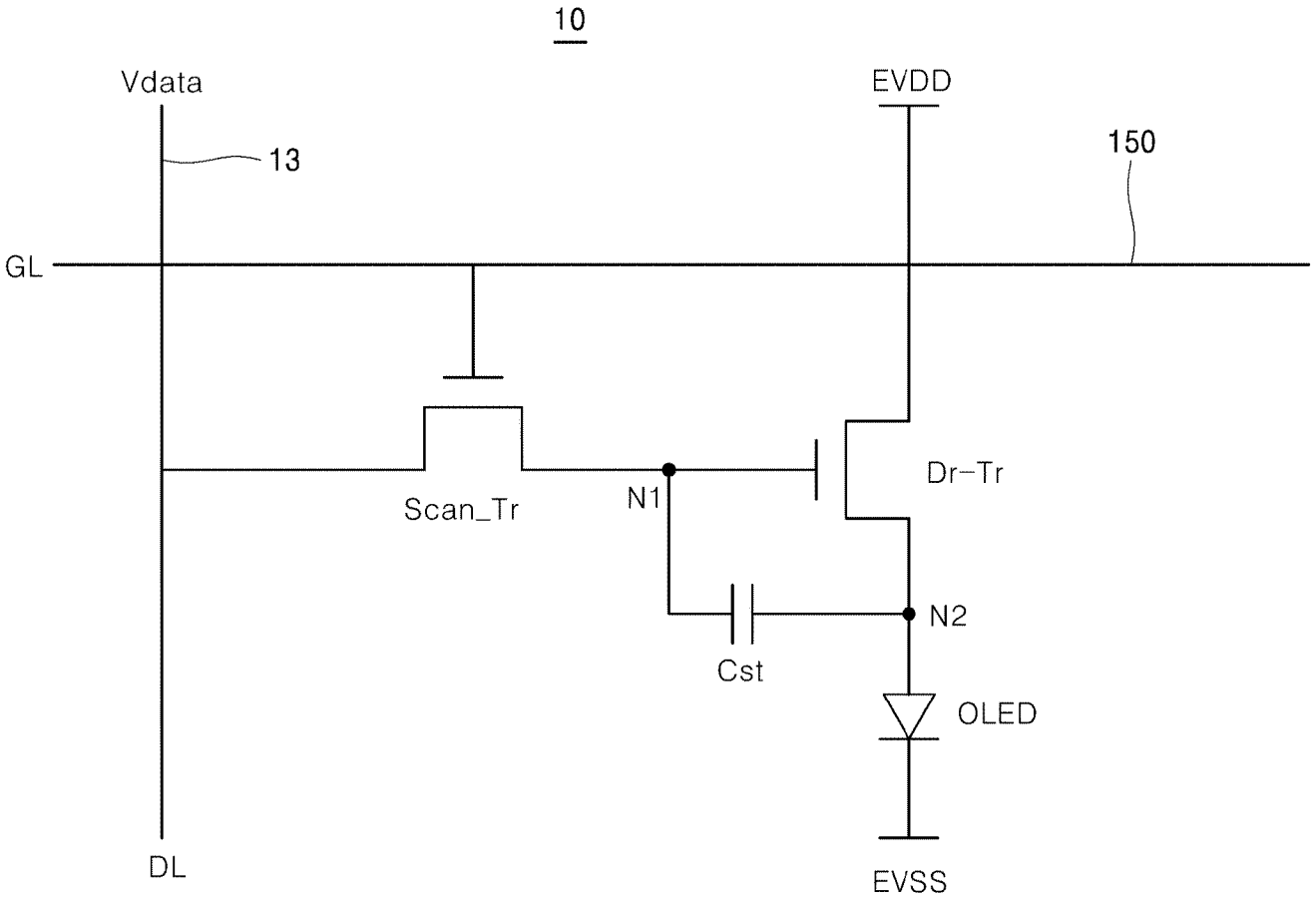
FIG. 3 is an equivalent circuit diagram of a pixel structure according to an exemplary embodiment of the present disclosure.

FIG. 3 is an equivalent circuit diagram of a pixel structure 10 according to an exemplary embodiment of the present disclosure. Hereinafter, the gate driving module according to the exemplary embodiment of the present disclosure will be described with reference to FIGS. 1 to 3.

A terminal of the first pull-up TFT 110 may be connected to a gate driving signal generator 160 and another terminal of the first pull-up TFT 110 may be connected to an end of a first gate line 150. The first pull-up TFT 110 may be a MOSFET, a BJT, an IGBT, etc., although the type of the first pull-up TFT 110 is not particularly limited herein. The gate driving signal generator 160 is an element that generates gate driving signals CLK1, CLK2, CLK3 and CLK4. The gate driving signals CLK1, CLK2, CLK3 and CLK4 refer to voltage signals that are applied to the gate line to turn on a scan transistor Scan_Tr. For example, the gate driving signals CLK1, CLK2, CLK3 and CLK4 may be, but is not limited to, clock signals.

A terminal of the first pull-down TFT 120 may be connected to the end of the first gate line 150 and another terminal of the first pull-down TFT 120 may be connected to a low-level voltage terminal 170. The low-level voltage terminal 170 is an element that supplies a DC voltage signal to the source terminal of the first pull-down TFT 120. The low-level voltage terminal 170 may be, but is not limited to, a DC voltage source. The first pull-down TFT 120 may be a MOSFET, a BJT, an IGBT, etc., although the type of the first pull-down TFT 120 is not particularly limited herein.

A terminal of the second pull-up TFT 130 may be connected to the gate driving signal generator 160 and another terminal of the second pull-up TFT 130 may be connected to the other end of the first gate line 150. The second pull-up TFT 130 may be a MOSFET, a BJT, an IGBT, etc., although the type of the second pull-up TFT 130 is not particularly limited herein. The first pull-up TFT 110, the first pull-down TFT 120 and the second pull-up TFT 130 may be of the same type or different types. The locations where the first pull-up TFT 110, the first pull-down TFT 120 and the second pull-up TFT 130 are disposed may be the same as or different from those shown in FIG. 1.

For example, when the first pull-up TFT 110 and the second pull-up TFT 130 are turned on, the first pull-down TFT 120 may be turned off. When the first pull-up TFT 110 and the second pull-up TFT 130 are turned off, the first pull-down TFT 120 may be turned on. Referring to FIG. 2(*b*), a signal 210 may be applied to the gate terminal of the first pull-up TFT 110. When the signal 210 is applied to the gate terminal of the first pull-up TFT 110, the first pull-up TFT 110 may be turned on during an interval 230.

Referring to FIG. 2(*c*), on the other hand, a signal 220 may be applied to the gate terminal of the first pull-down TFT 120. The signal 220 may be an inverted version of the signal 210. When the signal 220 is applied to the gate terminal of the first pull-down TFT 120, the first pull-down TFT 120 may be turned off during the interval 230. The signals in anti-phase shown in FIGS. 2(*b*)-2(*c*) may be applied to the gate terminals of the first pull-up TFT 110 and the first pull-down TFT 120, such that the TFTs are simultaneously and respectively turned on and off, and vice versa, in a repeating sequence.

For example, the gate driving module may further include a first inverter 140 having a terminal connected to the gate terminal of the first pull-up TFT 110 and the other terminal connected to the gate terminal of the first pull-down TFT 120. The first inverter 140 may invert the phase of the signal supplied to a Q1 node to output it to a $Q_b$1 node. For example, the first inverter 140 may change the signal 210 shown in FIG. 2(*b*) into the signal 220 shown in FIG. 2(*c*) to output it and apply it to the first pull-down TFT 120. When the first inverter 140 changes the signal 210 shown in FIG. 2(*b*) into the signal 220 shown in FIG. 2(*c*) to output it, the first pull-up TFT 110 and the first pull-down TFT 120 may be simultaneously and respectively turned on and off in a repeating sequence, in accordance with the anti-phase signals 210 and 220 shown in FIGS. 2(*b*)-2(*c*).

According to an exemplary embodiment of the present disclosure, the signal 210 applied to the gate terminal of the first pull-up TFT 110 may be applied to the Q1 node, and the signal 220 applied to the gate terminal of the first pull-down TFT 120 may be applied to the $Q_b$1 node. The signal 210 applied to the Q1 node may be inverted by the inverter to be applied to the gate terminal of the first pull-down TFT 120. The signals may be applied to the gate terminal of the first pull-up TFT 110 and the gate terminal of the first pull-down TFT 120 in different manners from the above-described manner.

The second pull-up TFT 130 and the first pull-up TFT 110, on the other hand, may be turned on simultaneously. More specifically, the signal 210 shown in FIG. 2(*b*) may be applied to the gate terminal of the second pull-up TFT 130 as well. As the signal 210 is applied to the gate terminals of the first pull-up TFT 110 and the second pull-up TFT 130 while the signal 220 is applied to the gate terminal of the first pull-down TFT 120, the first pull-up TFT 110 and the second pull-up TFT 130 are turned on while the first pull-down TFT 120 is turned off, and vice versa. By turning on the first pull-up TFT 110 and the second pull-up TFT 130 simultaneously, it is possible to avoid delays between time points when the pixels are turned on.

For example, when the first pull-up TFT 110 and the second pull-up TFT 130 are turned on while the first pull-down TFT 120 is turned off, the gate driving signals CLK1, CLK2, CLK3 and CLK4 generated by the gate driving signal generator 160 may be applied to the first gate line 150 via the first pull-up TFT 110 and the second pull-up TFT 130. In addition, when the first pull-up TFT 110 and the second pull-up TFT 130 are turned off while the first pull-down TFT 120 is turned on, the low-level voltage signal may be applied to the first gate line 150 via the first pull-down TFT 120. The low-level voltage signal may be a DC voltage signal.

More specifically, when the signal 210 is applied to the first pull-up TFT 110 and the second pull-up TFT 130, the first pull-up TFT 110 and the second pull-up TFT 130 are turned on during the interval 230. When the first pull-up TFT 110 and the second pull-up TFT 130 are turned on, some of the gate driving signals CLK1, CLK2, CLK3 and CLK4 may be applied to the first gate line 150 via the first pull-up TFT 110 and the second pull-up TFT 130. Referring to FIGS. 2(*a*)-2(*d*), the signal CKL1 among the gate driving signals CLK1, CLK2, CLK3 and CLK4 may be applied to at least one of the first pull-up TFT 110 and the second pull-up TFT 130. When the first pull-up TFT 110 and the second pull-up TFT 130 are on, the first pull-down TFT 120 may be off. Thereafter, the signal 220 may be applied to the gate terminal of the first pull-down TFT 120 to turn it on, while the. while the first pull-up TFT 110 and the second pull-up TFT 130 are turned off. When the first pull-down TFT 120 is turned on, a low-level voltage signal may be applied to the first gate line 150. When the first pull-up TFT 110 and the second pull-up TFT 130 are turned off, the gate driving signals CLK1, CLK2, CLK3 and CLK4 may no longer applied to the first gate line 150. As a result, a signal 330 shown in FIG. 2(*d*) may be applied to the first gate line 150, and the signal 330 may turn on the scan transistor Scan_Tr shown in FIG. 3.

Referring to FIG. 3, when the signal 330 is applied to the first gate line 150, the scan transistor Scan_Tr is turned on. When the scan transistor Scan_Tr is turned on, a data voltage signal Vdata is applied to a data line 13. The element that applies the data voltage signal to the data line 13 may be a data driver. The data voltage signal Vdata applied to the data line 13 is applied to a capacitor Cst or the gate terminal of a driving transistor Dr_Tr via the scan transistor Scan_Tr. When the data voltage signal is applied to the gate terminal of the driving transistor Dr_Tr, the driving transistor Dr_Tr is turned on. When the driving transistor Dr_Tr is turned on, a current flows through the driving transistor Dr_Tr. The current flowing through the driving transistor Dr_Tr may turn on an organic light-emitting diode (OLED).

In the above-described manner, the gate driving module according to the exemplary embodiment of the present disclosure can control the turn-on and turn-off operations of the scan transistor Scan_Tr. In addition, by controlling the turn-on and turn-off operations of the scan transistor Scan_Tr, the turn-on and turn-off timings of the organic light-emitting diode (OLED) can be controlled.

Figure 4:
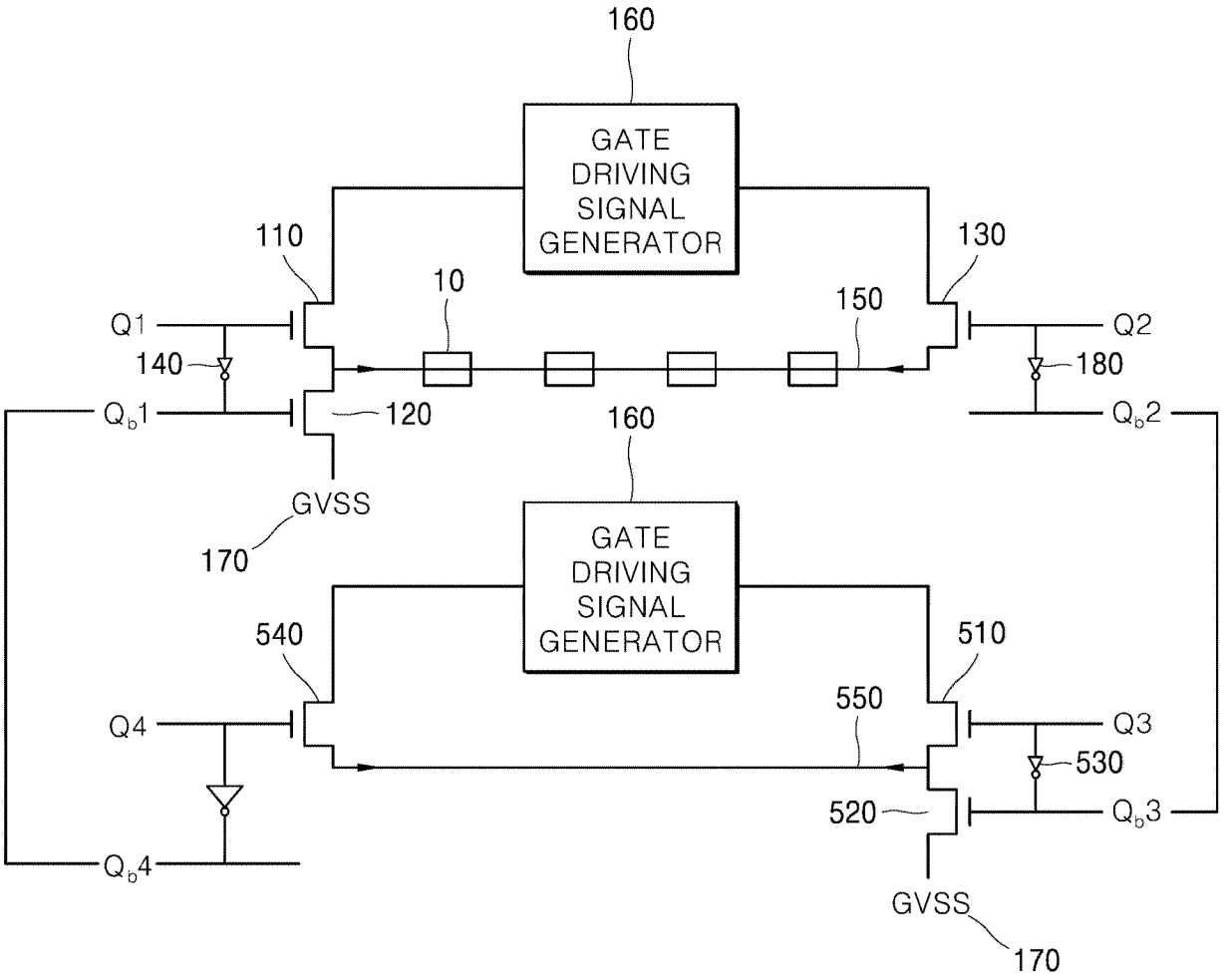
FIG. 4 is a diagram for illustrating a gate driving module according to another exemplary embodiment of the present disclosure.

FIG. 4 is a diagram for illustrating a gate driving module according to another exemplary embodiment of the present disclosure. Referring to FIG. 4, the gate driving module according to another exemplary embodiment of the present disclosure may further include a third pull-up TFT 510, a second pull-down TFT 520, a fourth pull-up TFT 540, a Q3 node, and a $Q_b$3 node.

A terminal of the third pull-up TFT 510 may be connected to the gate driving signal generator 160 of a second gate line and another terminal of the third pull-up TFT 510 may be connected to an end of the second gate line 550. The gate driving signal generator of the first gate line and the gate driving signal generator of the second gate line may be the different or the same. The third pull-up TFT 510 and the first pull-up TFT 110 may be of the same type or different types. In addition, the third pull-up TFT 510 may be driven in the same manner as the first pull-up TFT 110 and the second pull-up TFT 130 described above.

The $Q_b$3 node may be connected to the gate terminal of the second pull-down TFT 520, and may be connected to the gate terminal of the third pull-up TFT 510 via a third inverter 530. The structures, functions, and operations of the third pull-up TFT 510, the second pull-down TFT 520, the Q3 node, the $Q_b$3 node, and the third inverter 530 may be the similar to those of similar elements in FIG. 1. In addition, the $Q_b$3 node may be connected to a $Q_b$2 node which is connected to the gate terminal of the second pull-up TFT 130 via a second inverter 180. The $Q_b$3 node may have the same structure and function with the above-described $Q_b$1 node.

The $Q_b$3 node is connected to the $Q_b$2 node according to this exemplary embodiment of the present disclosure, such that the $Q_b$3 node may also perform the function of the $Q_b$2 node. As the $Q_b$3 performs the function of the $Q_b$2 node, the $Q_b$2 node may be eliminated. In addition, the inverter 530 performs the function of the inverter 180, and thus the inverter 180 may be eliminated. According to yet another exemplary embodiment of the present disclosure, a gate driving module can reduce the thickness of the bezel by eliminating the $Q_b$2 node and the inverter 180.

Figure 5:
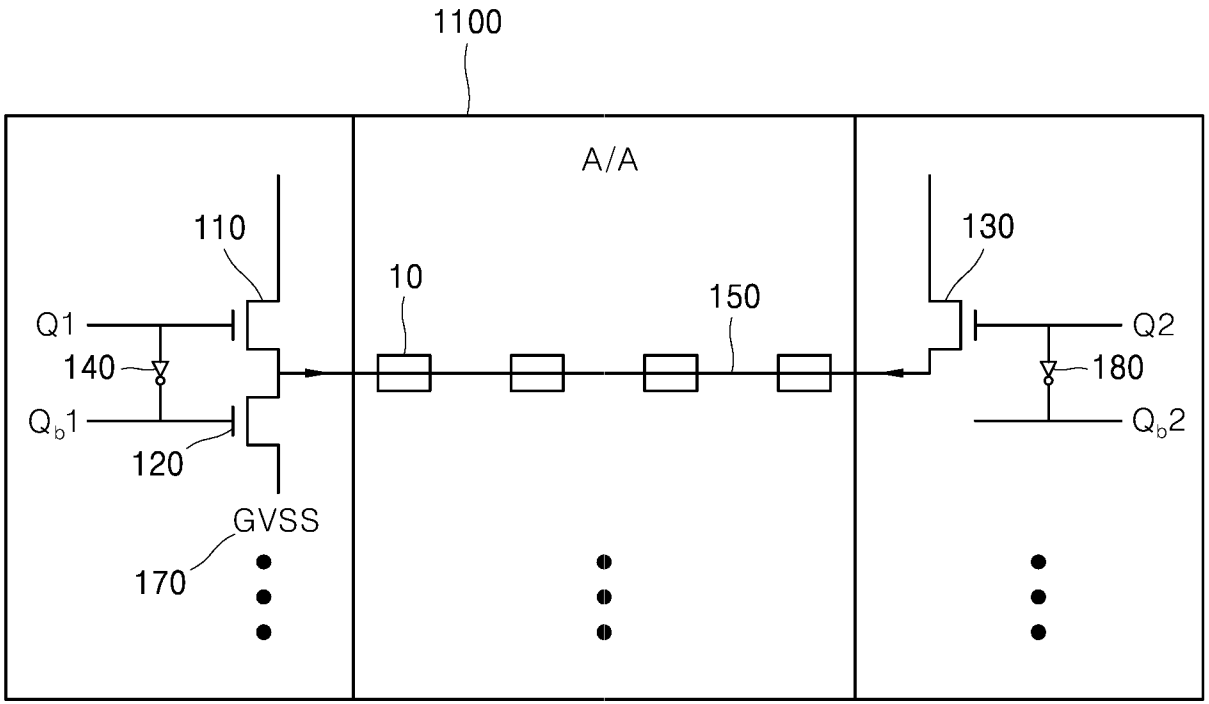
FIG. 5 is a diagram for illustrating a gate-in-panel according to an exemplary embodiment of the present disclosure.

FIG. 5 is a diagram for illustrating a gate-in-panel according to an exemplary embodiment of the present disclosure. Referring to FIG. 5, the gate-in-panel according to an exemplary embodiment of the present disclosure may include a first pull-up TFT 110, a first pull-down TFT 120, a second pull-up TFT 130, and an active area 1100. The gate-in-panel shown in FIG. 5 is merely an exemplary embodiment of the present disclosure, and the elements are not limited to those shown in FIG. 5. Some elements may be added, modified or eliminated as desired.

A terminal of the first pull-up TFT 110 may be connected to a gate driving signal generator 160 of a first gate line 150 and another terminal of the first pull-up TFT 110 may be connected to an end of the first gate line 150. The first pull-up TFT 110 may be a MOSFET, a BJT, an IGBT, etc., although the type of the first pull-up TFT 110 is not particularly limited herein. The gate driving signal generator 160 may be an element that generates gate driving signals CLK1, CLK2, CLK3 and CLK4. The gate driving signals CLK1, CLK2, CLK3 and CLK4 refer to voltage signals that are applied to the gate line to turn on a scan transistor Scan_Tr. For example, the gate driving signals CLK1, CLK2, CLK3 and CLK4 may be, but is not limited to, clock signals.

A terminal of the first pull-down TFT 120 may be connected to the end of the first gate line 150 and another terminal of the first pull-down TFT 120 may be connected to a low-level voltage terminal 170. The low-level voltage terminal 170 may be an element that supplies a DC voltage signal to the source terminal of the first pull-down TFT 120. The low-level voltage terminal 170 may be, but is not limited to, a DC voltage source. The first pull-down TFT 120 may be a MOSFET, a BJT, an IGBT, etc., although the type of the first pull-down TFT 120 is not particularly limited herein.

A terminal of the second pull-up TFT 130 may be connected to the gate driving signal generator 160 and another terminal of the second pull-up TFT 130 may be connected to the other end of the first gate line 150. The second pull-up TFT 130 may be a MOSFET, a BJT, an IGBT, etc., although the type of the second pull-up TFT 130 is not particularly limited herein. The first pull-up TFT 110, the first pull-down TFT 120 and the second pull-up TFT 130 may be of the same type or different types. The locations where the first pull-up TFT 110, the first pull-down TFT 120 and the second pull-up TFT 130 are disposed, and their functions may be the same as or different from those shown in FIG. 1.

For example, when the first pull-up TFT 110 and the second pull-up TFT 130 are turned on, the first pull-down TFT 120 may be turned off. When the first pull-up TFT 110 and the second pull-up TFT 130 are turned off, the first pull-down TFT 120 may be turned on. Referring to FIG.

2(*b*), a signal 210 may be applied to the gate terminal of the first pull-up TFT 110. When the signal 210 is applied to the gate terminal of the first pull-up TFT 110, the first pull-up TFT 110 is turned on during an interval 230.

Referring to FIG. 2(*c*), on the other hand, a signal 220 may be applied to the gate terminal of the first pull-down TFT 120. When the signal 220 is applied to the gate terminal of the first pull-down TFT 120, the first pull-down TFT 120 is turned off during the interval 230. The signals in anti-phase shown in FIG. 2 may be applied to the gate terminals of the first pull-up TFT and the first pull-down TFT, such that the TFTs may be simultaneously and respectively turned on and off in a repeating sequence, in accordance with the anti-phase signals 210 and 220 shown in FIGS. 2(*b*)-2(*c*).

For example, the gate driving module may further include a first inverter 140 having a terminal connected to the gate terminal of the first pull-up TFT 110 and the other terminal connected to the gate terminal of the first pull-down TFT 120. The first inverter 140 may invert the phase of the signal supplied to a Q1 node to output it to a $Q_b$1 node. For example, the first inverter 140 may change the signal 210 shown in FIG. 2(*b*) into the signal 220 shown in FIG. 2(*c*) to output it. As the first inverter 140 changes the signal 210 shown in FIG. 2(*b*) into the signal 220 shown in FIG. 2(*c*) to output it, the first pull-up TFT 110 and the first pull-down TFT 120 are turned on and off repeatedly.

According to an exemplary embodiment of the present disclosure, the signal 210 applied to the gate terminal of the first pull-up TFT 110 may be applied to the Q1 node, and the signal 220 applied to the gate terminal of the first pull-down TFT 120 may be applied to the $Q_b$1 node. The signal 210 applied to the gate terminal of the first pull-up TFT 110 may be applied to the Q1 node and inverted by the inverter to be applied as signal 220 to the gate terminal of the first pull-down TFT 120, and vice versa. Therefore the first pull-up TFT 110 and the first pull-down TFT 120 may be simultaneously and respectively turned on and off, and vice versa. The signals may be applied to the gate terminal of the first pull-up TFT 110 and the gate terminal of the first pull-down TFT 120 in different manners from the above-described manner.

The second pull-up TFT 130 and the first pull-up TFT 110, on the other hand, may be turned on simultaneously. More specifically, the signal 210 shown in FIG. 2(*b*) may be applied to the gate terminal of the second pull-up TFT 130 as well. As the signal 210 is applied to the gate terminals of the first pull-up TFT 110 and the second pull-up TFT 130 while the signal 220 is applied to the gate terminal of the first pull-down TFT 120, the first pull-up TFT 110 and the second pull-up TFT 130 may be turned on while the first pull-down TFT 120 is turned off, and vice versa. By turning on the first pull-up TFT 110 and the second pull-up TFT 130 simultaneously, it is possible to avoid delays between time points when the pixels are turned on.

For example, when the first pull-up TFT 110 and the second pull-up TFT 130 are turned on while the first pull-down TFT 120 is turned off, the gate driving signals CLK1, CLK2, CLK3 and CLK4 generated by the gate driving signal generator 160 may be applied to the first gate line 150 via the first pull-up TFT 110 and the second pull-up TFT 130. In addition, when the first pull-up TFT 110 and the second pull-up TFT 130 are turned off while the first pull-down TFT 120 is turned on, the low-level voltage signal may be applied to the first gate line 150 via the first pull-down TFT 120. The low voltage signal may be a DC voltage signal.

More specifically, when the signal 210 is applied to the first pull-up TFT 110 and the second pull-up TFT 130, the first pull-up TFT 110 and the second pull-up TFT 130 may be turned on during the interval 230, during which the first pull-down TFT 120 may be turned off. When the first pull-up TFT 110 and the second pull-up TFT 130 are turned on, some of the gate driving signals CLK1, CLK2, CLK3 and CLK4 may be applied to the first gate line 150 via the first pull-up TFT 110 and the second pull-up TFT 130. Referring to FIGS. 2(*a*)-2(*d*), the signal CKL1 among the gate driving signals CLK1, CLK2, CLK3 and CLK4 may be applied to the pull-up TFT. Thereafter, the signal 220 may be applied to the gate terminal of the first pull-down TFT 120 to turn it on, while the first pull-up TFT 110 and the second pull-up TFT 130 are turned off. When the first pull-down TFT 120 is turned on, the low-level voltage signal may be applied to the first gate line 150. When the first pull-up TFT 110 and the second pull-up TFT 130 are turned off, the gate driving signals CLK1, CLK2, CLK3 and CLK4 may no longer be applied to the first gate line 150. As a result, a signal 330 shown in FIG. 2(*d*) may be applied to the gate line, and the signal 330 may turn on the scan transistor Scan_Tr shown in FIG. 3.

In the active area 1100, scan operations may be carried out by applying gate driving signals CLK1, CLK2, CLK3 and CLK4 via the first gate line 150. The active area 1100 may include one or more pixel structures 10. Each of the pixel structures 10 may have the same configuration as the equivalent circuit shown in FIG. 3. White, red, green and blue organic light-emitting diodes (OLEDs) may be arranged in the order in the active area 1100. Organic light-emitting diodes (OLEDs) having the same color may also be arranged in a row.

A method of driving the active area 1100 will be described with reference to FIGS. 3 to 5. When a signal is applied to the first gate line 150, a scan transistor Scan_Tr is turned on. When the scan transistor Scan_Tr is turned on, a data voltage signal is applied to a data line 13. The element that applies the data voltage signal to the data line 13 may be a data driver. The data voltage signal applied to the data line 13 is applied to a capacitor Cst or the gate terminal of a driving transistor Dr_Tr via the scan transistor Scan_Tr. When the data voltage signal is applied to the gate terminal of the driving transistor Dr_Tr, the driving transistor Dr_Tr is turned on. When the driving transistor Dr_Tr is turned on, a current flows through the driving transistor Dr_Tr. The current flowing through the driving transistor Dr_Tr may turn on an organic light-emitting diode (OLED).

In the above-described manner, the gate-in-panel according to the exemplary embodiment of the present disclosure can control the turn-on and turn-off operations of the scan transistor Scan_Tr. In addition, by controlling the turn-on and turn-off operations of the scan transistor Scan_Tr, the turn-on and turn-off timings of the organic light-emitting diode (OLED) can be controlled.

Figure 6:
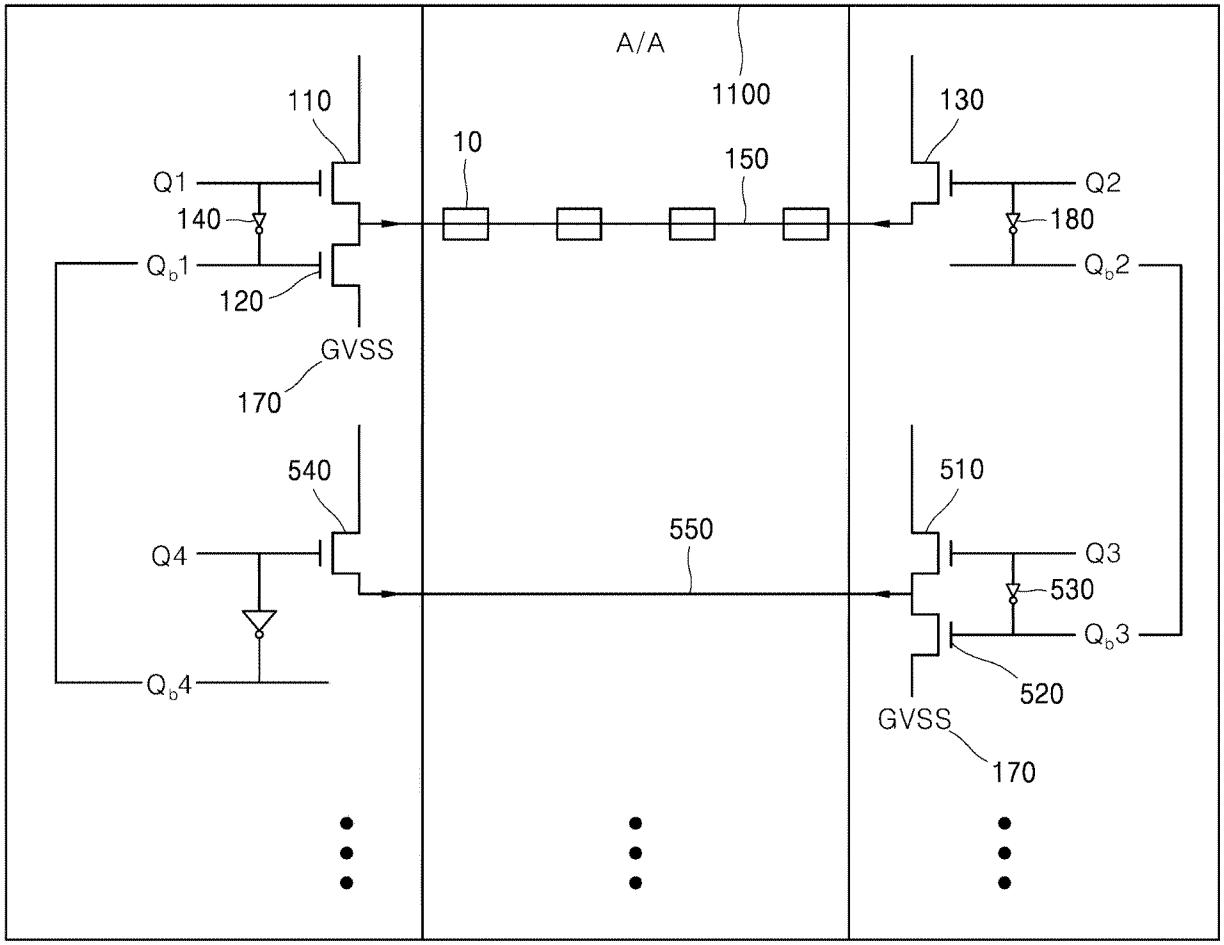
FIG. 6 is a diagram for illustrating a gate-in-panel according to another exemplary embodiment of the present disclosure.

FIG. 6 is a diagram for illustrating a gate-in-panel according to another exemplary embodiment of the present disclosure. Referring to FIG. 6, the gate-in-panel according to another exemplary embodiment of the present disclosure may further include a third pull-up TFT 510 and a $Q_b$3 node.

A terminal of the third pull-up TFT 510 may be connected to the gate driving signal generator 160 of a second gate line and another terminal of the third pull-up TFT 510 may be connected to an end of the second gate line. The gate driving signal generator of the first gate line and the gate driving signal generator of the second gate line may be different or the same. The third pull-up TFT 510 and the first pull-up TFT 110 may be of the same type or different types. In addition, the third pull-up TFT 510 may be driven in the same manner as the first pull-up TFT 110 and the second pull-up TFT 130 described above.

The $Q_b$3 node may be connected to the gate terminal of the third pull-up TFT 510 via a third inverter 530. In addition, the $Q_b$3 node may be connected to a $Q_b$2 node which is connected to the gate terminal of the second pull-up TFT 130 via a second inverter 180. The $Q_b$3 node may have the same structure and function with the above-described $Q_b$1 node.

The $Q_b$3 node may be connected to the $Q_b$2 node according to this exemplary embodiment of the present disclosure, such that the $Q_b$3 node may also perform the function of the $Q_b$2 node. As the $Q_b$3 performs the function of the $Q_b$2 node, the $Q_b$2 node may be eliminated. In addition, the third inverter 530 may perform the function of the inverter 180, and thus the second inverter 180 may be eliminated. According to another exemplary embodiment of the present disclosure, a gate-in-panel can reduce the thickness of the bezel by eliminating the $Q_b$2 node and the second inverter 180.

According to yet another exemplary embodiment of the present disclosure, a method of driving a gate may include: turning on a first pull-up TFT and a second pull-up TFT; applying a gate driving signal to a first gate line via the first pull-up TFT and the second pull-up TFT; turning off the first pull-up TFT and the second pull-up TFT; turning on a first pull-down TFT; and applying a low-level voltage signal to the first gate line via the first pull-down TFT.

Initially, the method according to this exemplary embodiment of the present disclosure starts with turning on the first pull-up TFT and the second pull-up TFT. To turn on the first pull-up TFT and the second pull-up TFT, the signal shown in FIG. 2(*a*) may be applied to the gate terminals of the first pull-up TFT and the second pull-up TFT.

Subsequently, the gate driving signal may be applied to the first gate line via the first pull-up TFT and the second pull-up TFT. The gate driving signals may be, but is not limited to, clock signals as shown in FIG. 2(*a*).

Subsequently, the first pull-up TFT and the second pull-up TFT are turned off, and the first pull-down TFT is turned on. The turning on the first pull-up TFT and the second pull-up TFT and the turning off the first pull-down TFT may be carried out simultaneously.

When the first pull-down TFT is turned on, a low-level voltage signal is applied to the first gate line via the first pull-down TFT. The low-level voltage signal may be, but is not limited to, a DC voltage signal. The applying the low-level voltage signal to the first gate line via the first pull-down TFT may be carried out prior to applying the gate driving signal to the first gate line via the first pull-up TFT and the second pull-up TFT. In addition, the applying the low-level voltage signal to the first gate line via the first pull-down TFT may be carried out after applying the gate driving signal to the first gate line via the first pull-up TFT and the second pull-up TFT.

More specifically, when the signal 210 is applied to the first pull-up TFT 110 and the second pull-up TFT 130, the first pull-up TFT 110 and the second pull-up TFT 130 are turned on during the interval 230. When the first pull-up TFT 110 and the second pull-up TFT 130 are turned on, the gate driving signals CLK1, CLK2, CLK3 and CLK4 are applied to the first gate line 150 via the first pull-up TFT 110 and the second pull-up TFT 130. Then, the signal 220 is applied to the gate terminal of the first pull-down TFT 120 to turn it on, while the first pull-up TFT 110 and the second pull-up TFT 130 are turned off. When the first pull-down TFT 120 is turned on, the low-level voltage signal is applied to the first gate line 150. When the first pull-up TFT 110 and the second pull-up TFT 130 are turned off, the gate driving signals CLK1, CLK2, CLK3 and CLK4 are no longer applied to the first gate line 150. As a result, a signal 330 shown in FIG. 2(*d*) is applied to the gate line, and the signal 330 turns on the scan transistor Scan_Tr shown in FIG. 3.

Referring to FIG. 3, when the signal 330 is applied to the first gate line 150, the scan transistor Scan_Tr is turned on. When the scan transistor Scan_Tr is turned on, a data voltage signal is applied to a data line 13. The element that applies the data voltage signal to the data line 13 may be a data driver. The data voltage signal applied to the data line 13 is applied to a capacitor Cst or the gate terminal of a driving transistor Dr_Tr via the scan transistor Scan_Tr. When the data voltage signal is applied to the gate terminal of the driving transistor Dr_Tr, the driving transistor Dr_Tr is turned on. When the driving transistor Dr_Tr is turned on, a current flows through the driving transistor Dr_Tr. The current flowing through the driving transistor Dr_Tr may turn on an organic light-emitting diode (OLED).

In the above-described manner, the method according to the exemplary embodiment of the present disclosure can control the turn-on and turn-off operations of the scan transistor Scan_Tr. In addition, by controlling the turn-on and turn-off operations of the scan transistor Scan_Tr, the turn-on and turn-off timings of the organic light-emitting diode (OLED) can be controlled.

According to an exemplary embodiment of the present disclosure, the number of TFTs can be reduced by sharing a pull-down TFT. For example, a gate driving module and a gate-in-panel according to an exemplary embodiment of the present disclosure can be usefully utilized by reducing the thickness of the bezel to allow viewers a more immersive visual experience. That is, the display device with the thinner bezel provides a more screen space, allowing a viewer to get immersed in the content displayed in the screen when the viewer watches a movie or a drama.

In addition, according to an exemplary embodiment of the present disclosure, the overall volume of the panel with respect to the size of the screen can be reduced by reducing the thickness of the bezel. For example, a gate driving module and a gate-in-panel according to an exemplary embodiment of the present disclosure can be usefully utilized by reducing the overall volume of the panel to reduce unnecessary space.

In addition, according to an exemplary embodiment of the present disclosure, the number of $Q_b$ nodes can be reduced by sharing a $Q_b$ node. For example, a gate driving module and a gate-in-panel according to an exemplary embodiment of the present disclosure can be usefully utilized by reducing the number of $Q_b$ nodes by connecting a $Q_b$ node to another $Q_b$ node. By sharing a $Q_b$ node, the inverter connected to the $Q_b$ node can also be shared, such that the thickness of the bezel can be reduced.

In addition, according to an exemplary embodiment of the present disclosure, turn-on and turn-off operations of a scan transistor can be controlled. For example, a gate driving module and a gate-in-panel according to an exemplary embodiment of the present disclosure can be usefully utilized by controlling the turn-on and turn-off operations of a pull-up TFT and a pull-down TFT to control a voltage signal applied to a gate line.

In addition, by controlling the turned-on and turned-off operations of the scan transistor, turned-on and turned-off timings of an organic light-emitting diode (OLED) can be controlled. For example, a gate driving module and a gate-in-panel according to an exemplary embodiment of the present disclosure can be usefully utilized by turning on or off organic light-emitting diodes in an arbitrary order.

In addition, according to an exemplary embodiment of the present disclosure, a delay between voltage signals applied to the active area can be reduced. For example, a gate driving module and a gate-in-panel according to an exemplary embodiment of the present disclosure can be usefully utilized when voltage signals applied to the active area are non-uniform so that the timings of turning on and off the organic light-emitting diodes become irregular. The present disclosure described above may be variously substituted, altered, and modified by those skilled in the art to which the present invention pertains without departing from the scope and sprit of the present disclosure. Therefore, the present disclosure is not limited to the above-mentioned exemplary embodiments and the accompanying drawing

What is claimed is:

1. A gate driving module comprising:

a first pull-up TFT having a terminal connected to a gate driving signal generator and another terminal connected to an end of a first gate line;

a first pull-down TFT having a terminal connected to the end of the first gate line and another terminal connected to a low-level voltage terminal;

a second pull-up TFT having a terminal connected to the gate driving signal generator and having another terminal, an another end opposite to the end of the first gate line connected only to the another terminal of the second pull-up TFT;

a third pull-up TFT having a terminal connected to the gate driving signal generator and another terminal connected to an end of a second gate line; and a $Q_b3$ node connected to a gate terminal of the third pull-up TFT via a third inverter, wherein the first pull-down TFT is turned off when the first pull-up TFT and the second pull-up TFT are turned on, and the first pull-down TFT is turned on when the first pull-up TFT and the second pull-up TFT are turned off, and wherein the $Q_b3$ node is connected to a $Q_b2$ node, the $Q_b2$ node being connected to a gate terminal of the second pull-up TFT via a second inverter.

2. The gate driving module of claim 1, wherein a gate driving signal generated by the gate driving signal generator is applied to the first gate line via the first pull-up TFT and the second pull-up TFT when the first pull-up TFT and the second pull-up TFT are turned on while the first pull-down TFT is turned off.

3. The gate driving module of claim 2, wherein the first gate line is connected to a pixel structure, the pixel structure comprising a data line, a scan transistor, a capacitor, and a driving transistor, wherein when the gate driving signal is applied to the first gate line, the scan transistor is turned on, and a data voltage is sequentially applied to the data line and to a gate terminal of the driving transistor via the scan transistor to turn on an organic light-emitting diode (OLED) connected to the transistor.

4. The gate driving module of claim 1, wherein a low-level voltage signal is applied to the first gate line via the first pull-down TFT when the first pull-up TFT and the second pull-up TFT are turned off while the first pull-down TFT is turned on.

5. The gate driving module of claim 1, further comprising: a first inverter having a terminal connected to a gate terminal of the first pull-up TFT and another terminal connected to a gate terminal of the first pull-down TFT.

6. The gate driving module of claim 5, wherein the first inverter inverts a signal applied to the first pull-up TFT and the second pull-up TFT and outputs the inverted signal to the first pull-down TFT.

7. An organic light-emitting diode (OLED) display including the gate driving module of claim 1.

8. A gate-in-panel comprising:

a first pull-up TFT having a terminal connected to a gate driving signal generator and another terminal connected to an end of a first gate line;

a first pull-down TFT having a terminal connected to the end of the first gate line and another terminal connected to a low-level voltage terminal;

a second pull-up TFT having a terminal connected to the gate driving signal generator and having another terminal, an another end opposite to the end of the first gate line connected only to the another terminal of the second pull-up TFT;

an active area in which a scan operation is carried out by a gate driving signal generated by the gate driving signal generator and applied via the first gate line;

a third pull-up TFT having a terminal connected to the gate driving signal generator and another terminal connected to an end of a second gate line; and a $Q_b3$ node connected to a gate terminal of the third pull-up TFT via a third inverter, wherein the first pull-down TFT is turned off when the first pull-up TFT and the second pull-up TFT are turned on, and the first pull-down TFT is turned on when the first pull-up TFT and the second pull-up TFT are turned off, and wherein the $Q_b3$ node is connected to a $Q_b2$ node, the $Q_b2$ node being connected to a gate terminal of the second pull-up TFT via a second inverter.

9. The gate-in-panel of claim 8, wherein the gate driving signal is applied to the first gate line via the first pull-up TFT and the second pull-up TFT when the first pull-up TFT and the second pull-up TFT are turned on while the first pull-down TFT is turned off.

10. The gate-in-panel of claim 9, wherein the first gate line is connected to a pixel structure, the pixel structure comprising a data line, a scan transistor, a capacitor, and a driving transistor, wherein when the gate driving signal is applied to the first gate line, the scan transistor is turned on, and a data voltage is sequentially applied to the data line and to a gate terminal of the driving transistor via the scan transistor to turn on an organic light-emitting diode (OLED) connected to the transistor.

11. The gate-in-panel of claim 8, wherein a low-level voltage signal is applied to the first gate line via the first pull-down TFT when the first pull-up TFT and the second pull-up TFT are turned off while the first pull-down TFT is turned on.

12. The gate-in-panel of claim 8, further comprising: a first inverter having a terminal connected to a gate terminal of the first pull-up TFT and another terminal connected to a gate terminal of the first pull-down TFT.

13. The gate-in-panel of claim 12, wherein the first inverter inverts a signal applied to the first pull-up TFT and the second pull-up TFT and outputs the inverted signal to the first pull-down TFT.

14. An organic light-emitting diode (OLED) display including the gate-in-panel of claim 8.

* * * * *